US005193592A

United States Patent [19]

Evilsizer et al.

[11] Patent Number: 5,193,592

[45] Date of Patent: Mar. 16, 1993

[54] CONNECTOR BANDING TOOL

[75] Inventors: William H. Evilsizer, Hillsboro; James D. Scruggs, Beaverton; Rodney L. Callister, Vernonia, all of Oreg.

[73] Assignee: Astro Tool Corp., Beaverton, Oreg.

[21] Appl. No.: 659,841

[22] Filed: Feb. 22, 1991

[51] Int. Cl.[5] ..... B21F 9/02

[52] U.S. Cl. ..... 140/93.2; 140/123.6

[58] Field of Search ..... 140/93.2, 93.4, 123.5, 140/123.6, 150, 152, 153, 154; 81/9.3

[56] References Cited

U.S. PATENT DOCUMENTS

| | | | |
|---|---|---|---|
| 3,118,473 | 1/1964 | Bell | 140/123.6 |
| 4,041,993 | 8/1977 | Angarola | 140/93.4 |
| 4,688,607 | 8/1987 | Wolcott | 140/93.2 |
| 4,928,738 | 5/1990 | Marelin et al. . | |
| 4,934,416 | 6/1990 | Tonkiss | 140/93.2 |
| 5,000,232 | 3/1991 | Wolcott . | |

*Primary Examiner*—Lowell A. Larson

*Attorney, Agent, or Firm*—Robert L. Harrington

[57] ABSTRACT

A connector banding tool includes a clutch tensioning arrangement to develop sufficient tension within a band surrounding a multi-conductor cable in order to secure a ground shield of said cable against a connector housing. The tool further includes a bending and cutting arrangement to cut and bend the band near the band buckle to a desired position in which the band may be bent over on top of the buckle to finally secure the band upon the connector housing. The described connector banding tool permits one-handed two-step operation including a first step of developing tension within the band surrounding the connector housing and a second step combining the bending and cutting of the band to leave a small upstanding portion near the buckle.

13 Claims, 4 Drawing Sheets

FIG. 4
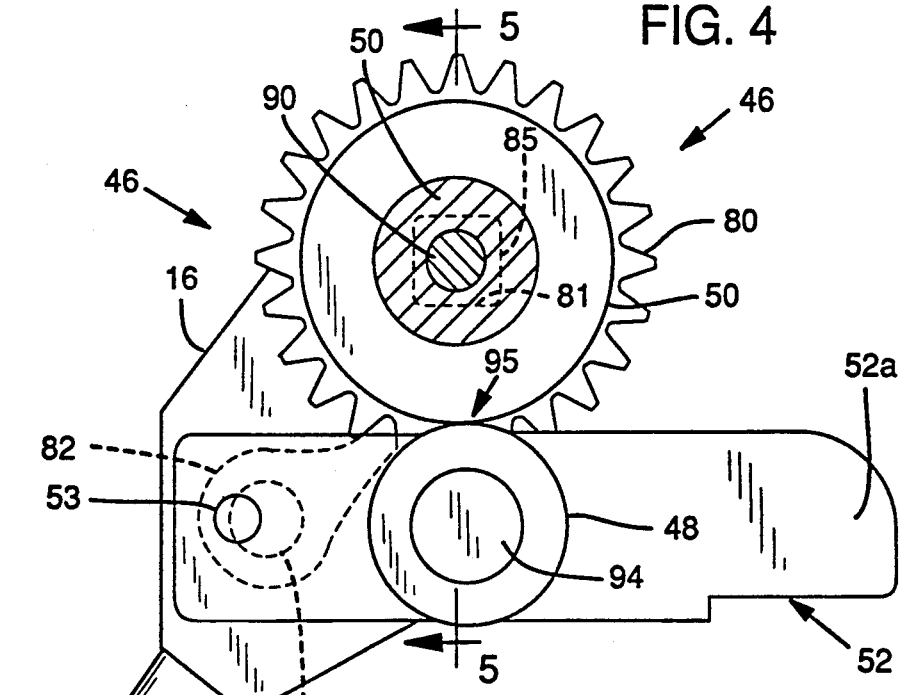
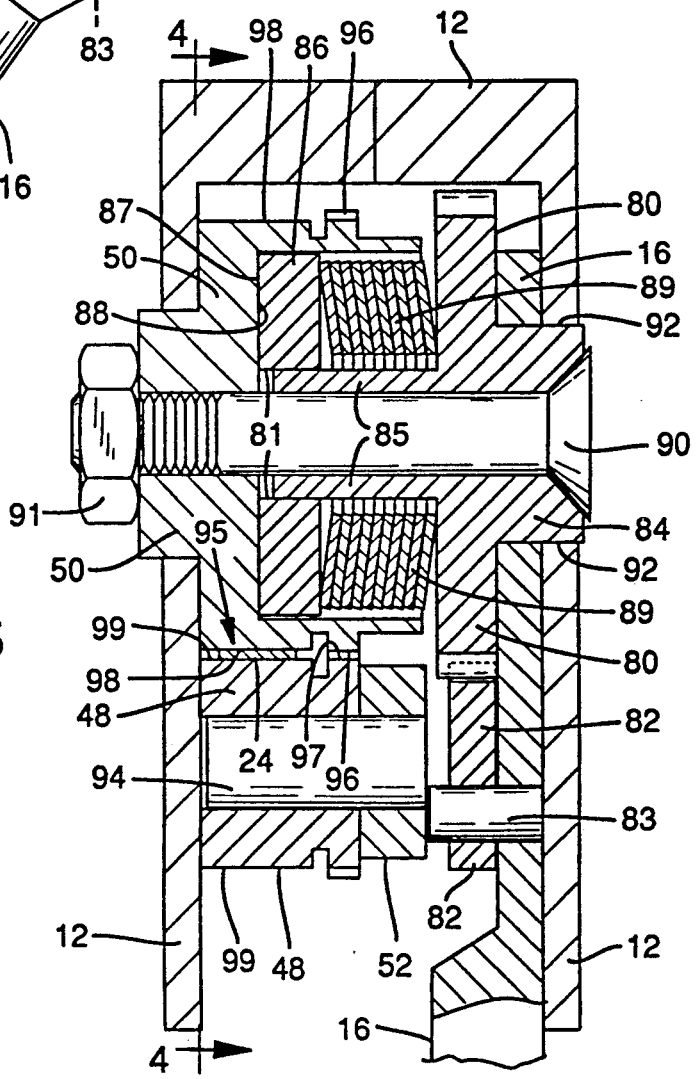
FIG. 5

CONNECTOR BANDING TOOL

FIELD OF THE INVENTION

The present invention relates generally to electronic assembly devices, and particularly to a banding apparatus for electrical connectors.

BACKGROUND OF THE INVENTION

An electrical connector is the terminal portion of a multiconductor cable. The connector plugs into a mating connector to establish electrical conductivity between conductors of the cable and conductors within a device attached to the mating connector. Electrical connectors find wide application in the electronics field, including particularly critical electrical systems such as in aviation circuitry where proper conductivity must be assured.

Generally, the electrical cable includes many individual conductors within a surrounding ground shield, e.g., a wire mesh sheath, to prevent external electrical interference with signals propagating along the cable conductors. The electrical conductors of the cable insert within a metal connector housing and terminate at individual connection sites corresponding to connection sites in the mating connector. The ground shield attaches to the exterior of the connector housing to establish both an electrical interference shield and a mechanical coupling between the cable and the connector housing. Such shielding and mechanical coupling is provided by a metal band encircling the ground shield and connector housing to capture the ground shield against the connector housing. The connector housing may include a groove or other such formation for receiving the band and more firmly securing the assembly. The band must maintain the ground shield mounting firmly upon the connector housing, typically according to a given specification criteria, in order to provide reliable function of the connector assembly.

Accordingly, it will be appreciated that the band surrounding the connector housing is critical to proper and reliable connector operation. The subject of the present invention concerns a tool adapted for efficiently applying such a band to a connector housing to provide a reliable electrical shielding and mechanical connection between the cable and the connector housing.

Heretofore, such banding tools have suffered from lack of convenient operation. Many such banding tools require multiple operational steps and in some cases, use of both of the operator's hands. Clumsy operation hinders efficient use of such banding tools. Often the band must be applied to the connector housing in a limited work space, e.g., behind a bulkhead, leaving little room for operator manipulation. In other applications, the band is mounted in an assembly line fashion requiring quick and convenient operation. Assembly of connector housings is improved, therefore, by more efficient and more convenient operation of the banding tool.

It is, therefore, desirable that a banding tool be conveniently operable to improve the efficiency of banding operations. The tool should provide a very secure mounting of the banding about the connector housing in order to insure, to the greatest degree possible, the mechanical and electrical connection between the cable and the connector housing.

SUMMARY OF THE INVENTION

The present invention provides an improved connector banding tool wherein the operator may perform a two-step banding operation using one hand. The banding tool includes a clutch arrangement for variably determining the tension developed in the band surrounding the connector prior to actuation of a cutting-bending arrangement. Such controllable tensioning provides consistent and reliable mounting of the band upon the connector housing. The cutting-bending arrangement cuts the band leaving a small upstanding portion of the band bent to secure the band upon the housing. The small upstanding portion is then bent fully over the buckle to its final position.

BRIEF DESCRIPTION OF THE DRAWINGS

For a better understanding of the invention, and to show how the same may be carried into effect, reference will now be made, by way of example, to the following drawings in which like reference numerals refer to like elements.

FIGS. 4 and 5 further illustrate the clutch tensioning arrangement of the banding tool of FIG. 1 for pulling the band into a desired tension about the connector housing prior to a bending and cutting step. FIG. 4 is a sectional view taken along lines 4—4 of FIG. 5 and FIG. 5 is a sectional view taken along lines 4—4 of FIG. 5.

FIG. 7 is taken along lines 7—7 of FIG. 6.

DETAILED DESCRIPTION OF THE PREFERRED EMBODIMENT

Figure 1:
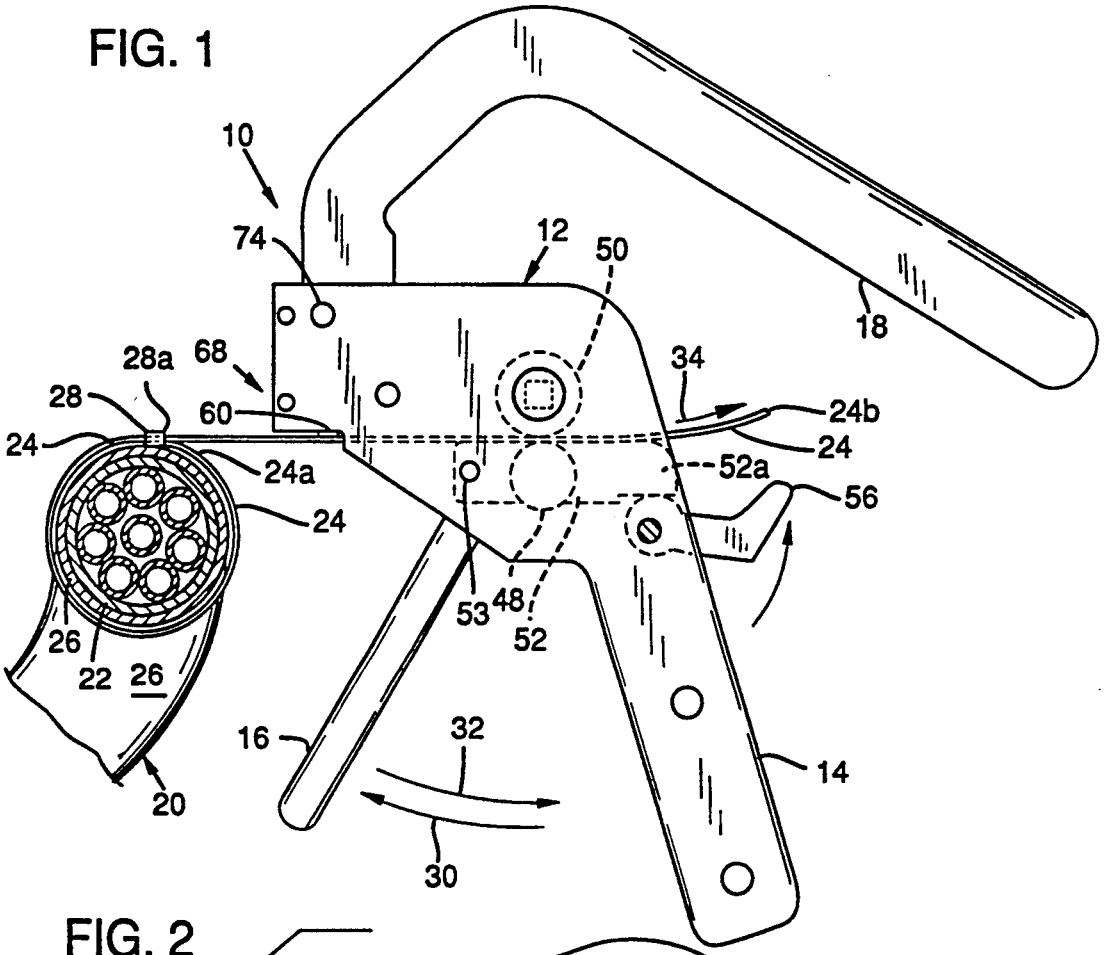
FIG. 1 is a side view of a banding tool in accordance with the present invention, a multi-conductor cable, a connector housing, and the associated band in preparation for a banding operation.

FIG. 1 illustrates a banding tool 10 according to a preferred embodiment of the present invention. Banding tool 10 comprises a tool body 12, a stationary handle 14, a band tensioning handle 16, and a bending and cutting handle 18. The term tool body 12, as used herein, shall refer generally to non-moving parts of tool 12 such as the tool housing and such structures to which other parts mount. FIG. 1 also illustrates a multi-conductor cable 20 to be attached to a connector housing 22 by way of band 24 using the banding tool 10. Conductor cable 20 includes an exterior ground shield 26 to be captured between housing 22 and band 24. A first end **24*a* of band 24 attaches to buckle 28. The opposite end 24*b* of band 24 inserts through buckle 28 whereby band 24 may encircle housing 22, but exterior of ground shield 26. In some applications the band may encircle the housing 22 more than once depending on the size of the connector housing 22. End 24*b* of band 24 then inserts through banding tool 10 as illustrated in FIG. 1. Tool 10 is then ready for a banding operation where, in a first step, band 24 is drawn through buckle 28 to tightly capture shield 26 against housing 22 and then, in a second step, bent and cut near buckle 28**.

Figure 2:
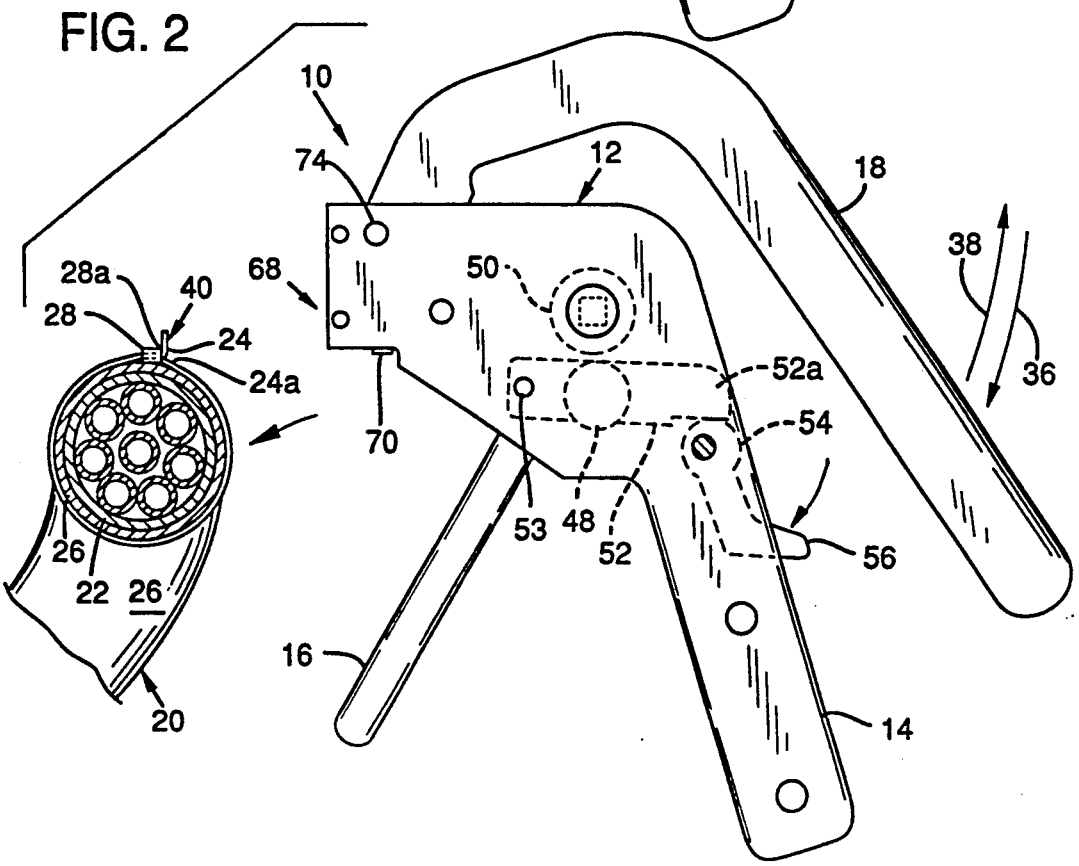
FIG. 2 shows the banding tool, cable, and banding of FIG. 1 following a banding operation.

FIG. 2 illustrates the result of the bending and cutting step. As described more fully below, band 24 bends at the outlet 28*a* of buckle 28 to prevent retraction of band 24 through buckle 28. Tension is thereby maintained in the portion of band 24 surrounding housing 22. The remaining distal upstanding portion 40 of band 24 is then bent down over the top of buckle 28 (as shown and later described in FIG. 10) to fully secure band 24 about housing 22.

Returning to FIG. 1, tensioning handle 16 operates by hand gripping action to draw band 24 through banding tool 10 and develop tension in the portion of band 24 encircling housing 22. More particularly, an operator of banding tool 10 grasps handles 14 and 16 and moves the handle 16 in the direction 32 toward handle 14. Handle 16 is spring biased in the opposite direction 30 whereby repeated gripping action of handles 14 and 16 results in movement of band 24 in the direction 34 as indicated in FIG. 1. As buckle 28 comes against a stop 60 of body 12, tension develops in the portion of band 24 encircling housing 22 and ground shield 26 is desirably captured against connector housing 22. As will be explained more fully hereafter, banding tool 10 includes a clutch arrangement for establishing and maintaining a desired tension in cable 24.

In FIG. 2, once the required tension is achieved, the operator of banding tool 10 reaches up using his or her thumb to grasp bending and cutting handle 18 for movement in the direction 36 toward tool body 12. Band 24 is thereby bent and cut leaving the upstanding portion 40 of band 24 adjacent buckle 28 as illustrated in FIG. 2. In a final bending step (FIG. 10), not involving the tool 10, portion 40 of band 24 is further bent against the top of buckle 28 to fully secure band 24 on housing 22.

Returning now to FIGS. 1 and 2, the operator of banding tool 10 may execute the banding operation using one hand and essentially two operational steps. First, the handle 16 is reciprocated by hand gripping action to develop tension in the portion of band 24 encircling housing 22. This tension is maintained in band 24 by virtue of the hereafter-described clutch tensioning arrangement of banding tool 10. In the second operational step, the user applies thumb gripping action to bring handle 18 near handle 14 and then applies hand gripping action to handle 18 to accomplish the bending and cutting action. Given the simplified operator steps needed to use banding tool 10, it may be appreciated that banding tool 10 is well adapted for work in close quarters or on assembly lines where the operator may have little room, or time, to accomplish the banding operation.

Figure 3:
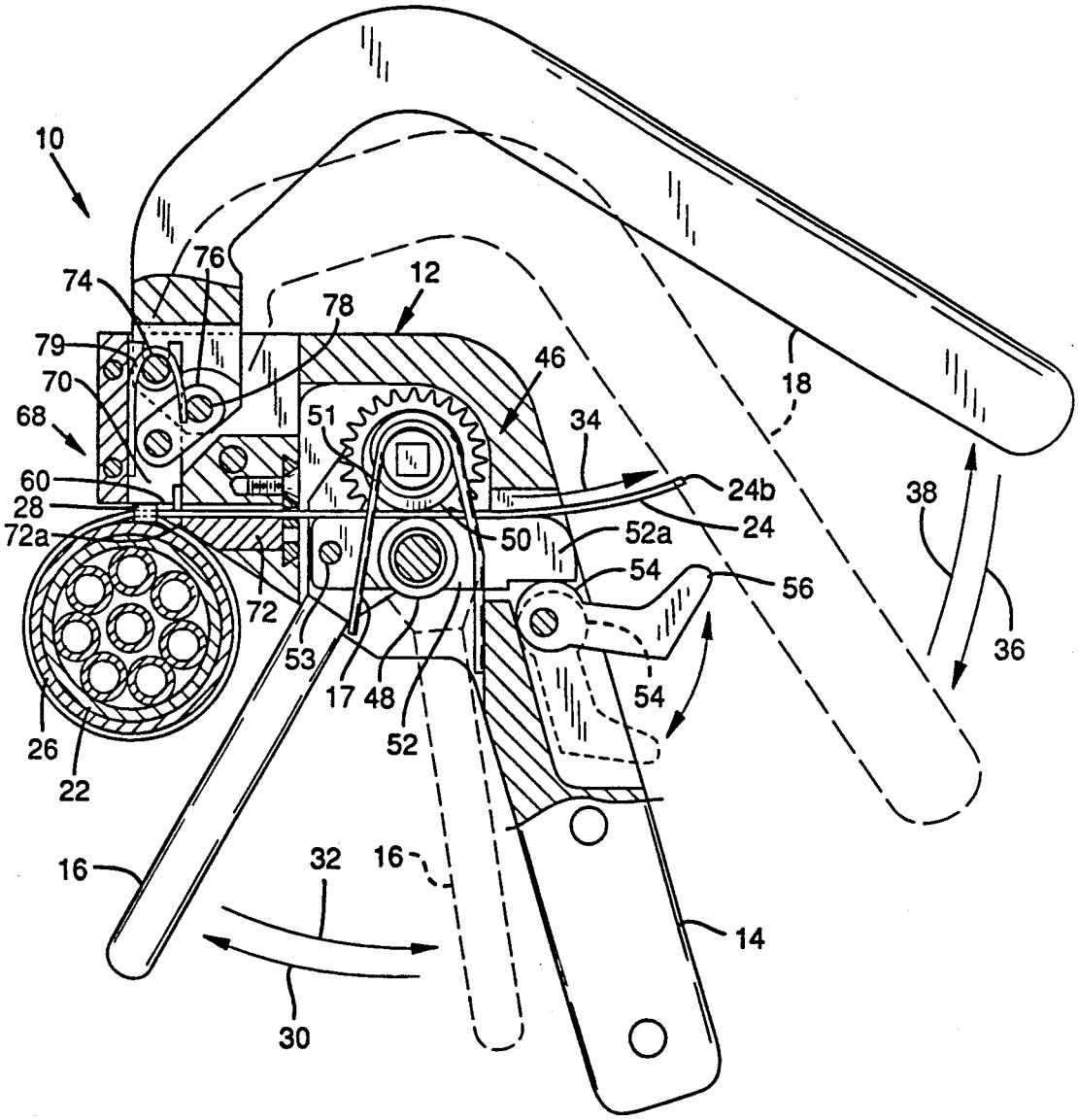
FIG. 3 is a view similar to FIGS. 1 and 2, but partially cut away to show a clutch tensioning arrangement and a bending and cutting arrangement.

FIG. 3 is a sectional view of the banding tool 10 illustrating features of the clutch tensioning arrangement 46 and bending and cutting arrangement 68 of banding tool 10. The clutch tensioning arrangement 46 responds to reciprocation of handle 16 by moving end 24*b* of band 24 in the direction 34 as previously indicated. Clutch tensioning arrangement 46 captures band 24 between a lower roller 48 and an upper roller 50. Reciprocation of handle 16 drives upper roller 50 into counter clockwise, as seen in FIG. 3, rotation. Spring 51 couples handle 16 and body 12 to bias handle 16 in the direction 30. Also, as explained more fully below, upper roller 50 contacts and drives lower roller 48 into clockwise, as seen in FIG. 3, rotation. In this manner, band 24, being captured at the nip of rotating rollers 48 and 50, advances in the direction 34. To maintain tension in the portion of band 24 surrounding housing 22, clutch tensioning arrangement 46 holds band 24 against movement in the direction opposite of direction 34 during the subsequent bending-cutting step.

Lower roller 48 rotatably mounts upon a roller base block 52 pivotally mounted at pin 53 to tool body 12. An eccentric 54 rotatably mounted to body 12 supports the distal end 52*a* of block 52. Counter clockwise rotation of eccentric 54 urges block 52 upward, as shown in FIG. 3, to releasably capture band 24 between rollers 48 and 50. A release handle 56 attaches to eccentric 54 whereby pivoting handle 56 upward in the view of FIG. 3, engages the clutch tensioning arrangement 46, i.e., moves lower roller 48 toward upper roller 50. Similarly, clutch tensioning arrangement may be disengaged by moving handle 56 downward and against handle 14. This feature of banding tool 10 is useful in initially inserting end 24*b* through tool 10 and also in removing end 24*b* from tool 10 following a bending operation. Also, clutch tensioning arrangement 46 may be disengaged to initially develop tension in the portion of band 24 surrounding housing 22 by manually pulling on band 24. Once band 24 is hand tightened about housing 22, clutch tensioning arrangement 46 is engaged.

As end 24*b* of band 24 moves in the direction 34, the buckle 28 comes to bear against a stop 60. Further movement of band 24 in the direction 34 develops tension in the portion of band 24 surrounding housing 22. Clutch tensioning arrangement 46 advances band 24 until a given level of tension develops and then, as explained more fully below, begins to slip so as to limit the amount of tension provided. Tensioning arrangement 46 may be adjusted to vary the amount of tension developed in band 24, but typically a fixed tension is required for consistency and to meet given specification requirements. After the band 24 is suitably tightened about housing 22, the next operational step is the bending and cutting of band 24.

The cutting and bending arrangement 68 of banding tool 10 includes an upper cutting block 70 captured within body 12 of banding tool 10, but allowed vertical movement therein. A lower cutting block 72 fixedly mounted upon body 12 is positioned with its cutting hardened edge 72*a* adjacent the vertical movement path of upper cutting block 70. The stop 60 is fixed to body 12 adjacent the path of upper cutting block 70. Band 24 lies across the top of lower cutting block 72 and transverse to cutting edge 72*a*. As band 24 moves across lower cutting block 72 buckle 28 approaches cutting edge 72*a* of cutting block 72, but halts short of edge 72*a* when buckle 28 comes against stop 60.

Cutting and bending handle 18 pivotally attaches to body 12 at the pin 74 which is fixed to body 12 . In response to thumb gripping action of handle 18 and movement in the direction 36, handle 18 rotates about the pin 74. A link 76 couples, at pins 78, the handle 18 and upper cutting block 70. As handle 18 rotates about pin 74 in the direction 36, pin 78 moves through an arc about the pin 74 and drives the upper cutting block 70 downward to sever band 24. Spring 79 encircles pin 74 and couples body 12 and pin 78 to bias handle 18 in the other direction 38 to raise cutting block 70 upon release of handle 18. As described more fully hereafter, the downward stroke of handle 18 accomplishes both a bending and a cutting operation on band 24 leaving band 24 in a desired configuration, i.e., with upstanding portion 40 (FIGS. 2 and 9), in preparation for a final bending step (FIG. 10) to secure band 24 upon housing 22.

FIGS. 4 and 5 illustrate further details of the clutch tensioning arrangement of banding tool 10. In FIG. 4, the ratchet gear 80 is held in check by spring biased pawl 82 which is rotatably mounted to and carried by handle 16 at pin 83. Pawl 82 is suitably spring biased (not shown) against ratchet gear 80. Thus, rotation of upper roller 50 is limited to one rotational direction, i.e., counter clockwise in the view FIGS. 3 and 4. More particularly, as handle 16 moves in direction 32 pawl 82 bears against gear 80 to drive gear 80 into counter clockwise rotation. As handle 16 returns in the opposite direction 30, pawl 82 rides over the gears of gear 80. Gear 80 is blocked against rotation in the clockwise rotational direction by virtue of the load friction between the rollers 48 and 50 and band 24 as captured therebetween. Also, gear 80 is held against clockwise rotation by direct contact, discussed below, between rollers 48 and 50. Without band 24 so captured between rollers 48 and 50 and the direct contact between rollers 48 and 50, gear 80 would move in the counter clockwise rotation, i.e., follow movement of handle 16 in the direction 30.

Turning now to FIG. 5 in conjunction with FIG. 4, the clutch and tensioning arrangement 46 of tool 10 operates as follows. The handle 16 rotatably mounts to a transfer block 84. Gear 80 is fixedly mounted to the transfer block 84 and reciprocation of handle 16, as described above, provides rotation of gear 80 by way of pawl 82. Thus, upon rotation of gear 80, transfer block 84 also rotates. Transfer block 84 includes a drive extension 85 of substantially square cross section and adapted to fit into a corresponding aperture 81 of a clutch plate 86. Accordingly, rotation of gear 80 corresponds directly to rotation of clutch plate 86, but plate 86 has some axial movement relative to extension 85. A clutch surface 87 of clutch plate 86 bears against a corresponding clutch surface 88 of upper roller 50. Spring washers 89, captured between transfer block 84 and clutch plate 86, cause surface 87 of clutch plate 86 to bear against surface 88 of upper roller 50. A tensioning screw 90 and bolt 91 couple transfer block 84 and upper roller 50 for relative axial movement thereof. Adjustment of screw 90 results in increased or decreased pressure between the surfaces 88 and 87. Accordingly, rotation of gear 80 results in rotation of roller 50 only to the extent that resistive forces against roller 50, i.e., tension in band 24, are less than the tension adjustment provided by bolt 91 and screw 90. When the tension in band 24 exceeds the mutual pressure between surfaces 87 and 85, clutch arrangement 46 begins to slip. This indicates that the desired level of tension in band 24 is achieved.

The above-described clutch assembly mounts to body 12 of tool 10 at the bearing surface 92 of transfer block 84 and the bearing surface 93 of upper roller 50.

The clutch and tensioning arrangement 46 of tool 10 further includes the block 52 as previously described including a pin 94 extending therefrom and rotatably carrying the lower roller 48 thereon. Upper roller 50 and lower roller 48 thereby provide the desired pinching function for drawing band 24 through tool 10. More particularly, the band 24 is captured at the juncture 95 with pinching pressure thereon determined by adjustment of eccentric 54 as previously described.

Upper roller 50 directly drives the lower roller 48. More particularly, the surface 96 of upper roller 50 is provided with a 10 TPI straight knurl transverse to band 24. A similar 10 TPI straight knurl is provided on surface 97 of roller 48 whereby surfaces 96 and 97 of rollers 48 and 50, respectively, come together during operation, i.e., with band 24 captured between rollers 48 and 50. Upper roller 50 thereby drives lower roller 50 into rotation when tensioning band 24. The surface 98 of upper roller 50 contacting band 24 is provided with a 20 TPI straight knurl while the opposing surface 99 of lower roller 48 contacting band 24 is provided with a 20 TPI diamond knurl. The knurls of surfaces 98 and 99 provide increased frictional contact for gripping band 24 while tensioning band 24 about housing 22. Other knurl designs should, as will be appreciated by those skilled in the art, provide satisfactory operation of tool 10.

Thus, for a given target tension of band 24 about housing 22, screw 90 is adjusted according to the desired tension. Typically, the tensioning in band 24 is fixed and need not be adjusted, therefore, under ordinary operating conditions screw 90 need not be adjusted.

Figure 6:
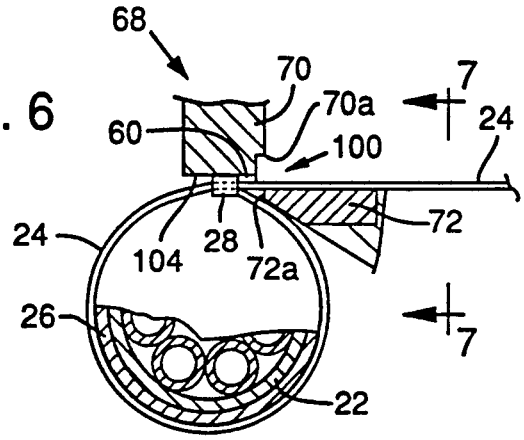
FIGS. 6–9 illustrate operation of the bending and cutting arrangement of the banding tool of FIG. 1.

FIGS. 6–9 illustrate the bending and cutting step performed by the banding tool 10. In FIGS. 6, 8, 9 and 10, the shield 26 20 and housing 22 are partially shown to clarify the view of bending and cutting arrangement 68, but it will be understood that in the illustrated steps the band 24 is encircling shield 26 and housing 22. In FIG. 6, following the first step of tensioning band 24 about housing 22, block 70 is moved downward by thumb gripping operation of handle 18. Just prior to the downward stroke of block 70, buckle 28 bears against stop 60, and band 24 lies across the top of lower cutting block 72 transverse to cutting edge 72*a*. Upper cutting block 70 includes a rectangular notch formation 100 positioned for movement past the cutting edge 72*a* of block 72. Notch formation 100 defines a cutting edge 70*a* of upper cutting block 70 which closely passes by cutting edge 72*a* of lower cutting block 72 to sever band 24. Cutting edge 70*a* is spaced from, i.e. follows by a distance, the leading or lower surface 104 of block 70.

Figure 7:
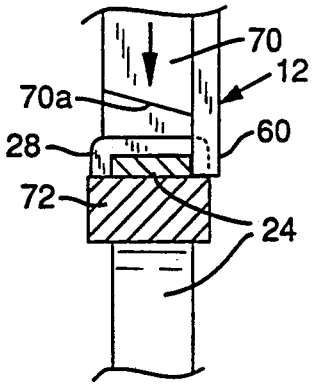

Turning to FIG. 7, as block 70 moves downward and edge 70*a* approaches edge 72*a*, notch 100 defines a band receiving space 106 between blocks 70 and 72. Band 24 occupies the space 106 of notch formation 100 during the downward stroke of block 70 as edge 70*a* approaches edge 72*a*. Buckle 28 disengages stop 60, but because clutch tensioning arrangement 46 holds band 24 against movement, band 24 is bent upward, i.e., away from housing 22, in the vicinity of buckle 28. As the cutting edge 70*a* of upper cutting block 70 approaches band 24, band 24 is actually further tensioned about housing 22. As cutting edge 70*a* comes into contact with band 24 in the downward stroke of upper cutting block 70, band 24 is severed.

Figure 8:
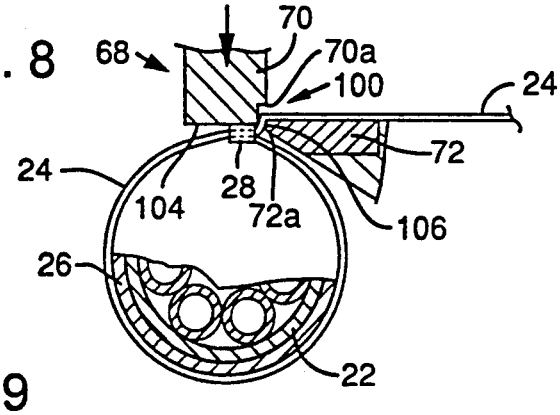

With reference to FIG. 8, cutting edge 70*a* of upper cutting block 70 is desirably angled, e.g., by five degrees, relative to the upper surface of band 24 in order to sever band 24 is a scissors-like fashion rather than attempting to cut the entire width of band 24 at once. Such scissor action of cutting edge 70*a* greatly reduces the amount of handle 18 force required to sever band 24. Also in FIG. 8, it is seen that stop 60 need only contact a corner of buckle 28. Accordingly, the width of cutting block 70 must be at least that of band 24, but must allow for contact between buckle 28 and stop 60.

Figure 9:
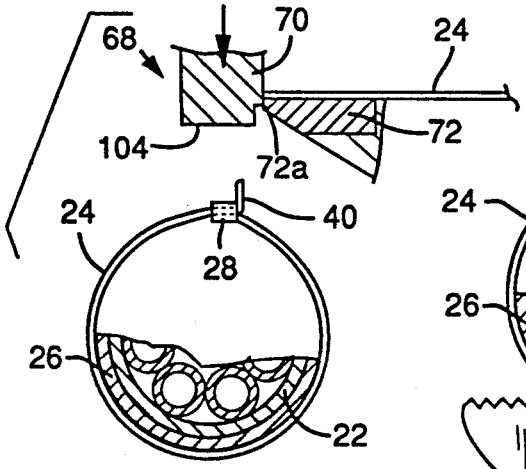
Figure 10:
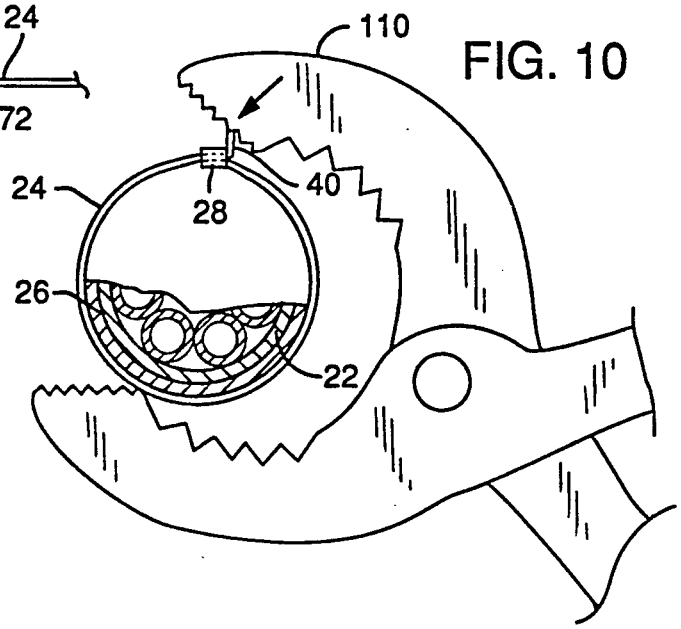
FIG. 10 shows a final bending step.

FIG. 9 illustrates the positions of blocks 70 and 72 following cutting of band 24. More particularly, the edge 70*a* has passed the edge 72*a* to cut band 24. As band 24 is cut, the connector 22 and portion of band 24 surrounding connector 22 separate from tool 10 as shown in FIG. 9. The portion 40 of band 24 desirably bends upward at approximately 90 degrees relative to the remainder of band 40 within buckle 28 and thereby secures band 40 against release of tension about housing 22. In FIG. 10, portion 40 may then be bent over the top of buckle 28 in a variety of ways, e.g. by pliers 110.

Thus, a connector banding tool has been shown and described. The tool simplifies user operation by reducing a banding operation to two basic steps, hand gripping to develop tension in the band and thumb gripping to both bend and cut the band into the desired configuration. The tool is thereby well adapted for convenient use in close quarters or on assembly lines. Also, the tool accommodates a very secure band mounting once the upstanding portion is bent over the top of the band buckle.

While a preferred embodiment of the present invention has been shown and described, it will be apparent to those skilled in the art that many variations from the illustrated embodiment are possible. The following claims, therefore, set forth the scope of the invention.

We claim:

1. A banding tool for mounting a band on a multi-conductor cable housing to capture a ground shield of the cable against the housing, the band comprising a first length portion surrounding the housing and passing through a band buckle and a second length portion extending from the band buckle, the tool comprising:

a rotary clutch tensioning arrangement for developing tension in the first length portion of the band by engaging the band buckle and the second length portion to draw the band through the band buckle, said rotary clutch tensioning arrangement including first and second band contacting rollers capturing said second length portion at a nip therebetween for advancing said second length portion in response to rotation of said rollers, said first and second rollers including a drive coupling therebetween for coordinated rotation thereof;

a bending and cutting arrangement for bending the second length portion at a point adjacent the band buckle whereby tension is maintained in the first length portion as said bending and cutting arrangement severs the second length portion to leave an upstanding portion of the band adjacent the buckle such that said upstanding portion is of sufficient length for further bending over the top of the buckle.

2. A tool according to claim 1 wherein said rotary clutch and tensioning arrangement comprises:

a first roller operatively coupled to a handle for rotation in a first rotational direction about a first axis in response to user actuation of said handle; and a second roller mounted for rotation about a second axis in spaced parallel relation to said first axis and adjacent the first roller in such position to pinch said band between said first and second rollers and advance the band through the tool in response to rotation of the first roller in said first rotational direction.

3. A tool according to claim 2 wherein said rotary clutch and tensioning arrangement comprises:

a first block carrying a first clutch surface, said first block being rotatably coupled to said first roller;

a second block carrying a second clutch surface in face-to-face contact with said first clutch surface, the second block being operatively coupled to said handle whereby actuation of said handle causes rotation of said second clutch surface; and a tensioning mechanism urging together said first and second blocks to establish a frictional relationship between said first and second surfaces whereby repeated actuation of said handle causes advancement of the band through the tool to such point that said frictional relationship allows relative movement between said first and second blocks and limits the amount of tension provided in the band.

4. A tool according to claim 2 further comprising:

a roller block pivotally mounted upon the tool with the second roller rotatably mounted thereon; and roller block positioning mechanism allowing selective positioning of said second roller toward and away from said first roller including a band engagement position for selectively pinching the band between the first and second rollers.

5. A tool according to claim 4 wherein said roller block positioning mechanism comprises an eccentric cam engaging said roller block in such manner that rotation of the cam accomplishes toward and away movement of said second roller relative to said first roller.

6. A banding tool for mounting a band on a multi-conductor cable housing to capture a ground shield of the cable against the housing, the band comprising a first length portion surrounding the housing and passing through a band buckle and a second length portion extending from the band buckle, the tool comprising:

a rotary clutch tensioning arrangement for developing tension in the first length portion of the band by engaging the band buckle and the second length portion to draw the band through the band buckle;

a bending and cutting arrangement for bending the second length portion at a point adjacent the band buckle whereby tension is maintained in the first length portion as said bending and cutting arrangement severs the second length portion to leave an upstanding portion of the band adjacent the buckle such that said upstanding portion is of sufficient length for further bending over the top of the buckle, said bending and cutting arrangement comprising:

a first cutting block movable relative to the body of said tool in a substantially rectilinear cutting stroke direction, having a leading face, and having a notch formation defining a first cutting edge spaced from said leading surface a distance corresponding to the length of the upstanding portion of the band; and a second cutting block stationary with respect to the body of said tool and having a second cutting edge adjacent the path of the first cutting edge whereby said band may be positioned across the second cutting block transverse of the second cutting edge such that a cutting stroke of said first cutting block first captures the band within the space of the notch formation and between the first and second cutting blocks to bend the band and then severs the band when the first cutting edge passes the second cutting edge to leave said upstanding portion adjacent the band buckle.

7. A tool according to claim 6 wherein said cutting and bending arrangement further comprises a stop formation affixed to said tool and positioned to engage the band buckle, the stop formation being spaced along the length of the band from the point of coincidence of said first and second cutting edges whereby said band buckle is held at said stop formation when said first cutting block first engages the band.

8. A banding tool for mounting a band on a multi-conductor cable housing to capture a ground shield of the cable against the housing, the band comprising a first length portion surrounding the housing and passing through a band buckle and a second length portion extending from the band buckle, the tool comprising:

a rotary clutch tensioning arrangement for developing tension in the first length portion of the band by engaging the band buckle and the second length portion to draw the band through the band buckle;

a bending and cutting arrangement for bending the second length portion at a point adjacent the band buckle whereby tension is maintained in the first length portion as said bending and cutting arrangement severs the second length portion to leave an upstanding portion of the band adjacent the buckle such that said upstanding portion is of sufficient length for further bending over the top of the buckle; and a stationary handle opposed by first and second spring biased handles, the first and second spring biased handles each being biased away from the stationary handle whereby said rotary clutch tensioning arrangement operates by gripping action of the first spring biased handle toward said stationary handle and said bending and cutting arrangement by gripping action of said second spring biased handle toward said stationary handle.

9. A banding tool for mounting a band on a multi-conductor cable housing to capture a ground shield of the cable against the housing, the band comprising a first length portion surrounding the housing and passing through a band buckle and a second length portion extending from the band buckle, the tool comprising:

a tool body including a stationary handle;

a tensioning handle pivotally mounted to said tool body, opposed to said stationary handle, and spring biased away from said stationary handle;

band tensioning means responsive to reciprocation of said tensioning handle toward and away from said stationary handle to develop and maintain tension in the first length portion of the band;

a bending and cutting handle pivotally mounted to said tool body, opposed to said stationary handle and spring biased away from said stationary handle; and band cutting and bending means responsive to pivoting of said bending and cutting handle toward said stationary handle to bend the second length portion of the band at the band buckle and to sever the second length portion leaving an upstanding portion of the band of sufficient length to allow further bending over the top the buckle.

10. A tool according to claim 9 wherein said bending and cutting means comprises:

a first cutting block movable relative to said tool body in a substantially rectilinear cutting stroke direction, having a leading face, and having a notch formation defining a first cutting edge spaced from said leading surface a distance corresponding to the length of the upstanding portion of the band; and a second cutting block stationary with respect to the body of said tool and having a second cutting edge adjacent the path of the first cutting edge whereby said band may be positioned across the second cutting block transverse of the second cutting edge such that the cutting stroke of said first cutting block first captures the band within the space of the notch formation between the first and second cutting blocks to bend the band and then severs the band when the first cutting edge passes by the second cutting edge leaving said upstanding portion adjacent the band buckle.

11. In a connector banding tool adapted for mounting a band on a multi-conductor cable housing to capture a ground shield of the cable against the housing, the band comprising a first length portion surrounding the housing and passing through a band buckle and a second length portion extending from the band buckle, a cutting and bending arrangement comprising:

a first cutting block movable in a substantially rectilinear cutting stroke direction, having a leading face, and having a notch formation defining a first cutting edge spaced from said leading surface; and a second cutting block stationary with respect to the body of said tool and having a second cutting edge adjacent the path of the first cutting edge whereby said band may be positioned across the second cutting block transverse of the second cutting edge such that the cutting stroke of said first cutting block first captures the band within the space of the notch formation between the first and second cutting blocks to bend the band and then severs the band when the first cutting edge passes by the second cutting edge leaving an upstanding distal portion of the band bent adjacent over the band buckle and of sufficient length for further bending over the top of the buckle.

12. A cutting and bending arrangement according to claim 11 wherein said cutting and bending arrangement further comprises:

a stop formation affixed to said tool and positioned to engage the band buckle, the stop formation being spaced along the length of the band from the point of coincidence of said first and second cutting edges whereby said band buckle is held at said stop formation when said first cutting block first engages the band.

13. A banding tool for mounting a band on a multi-conductor cable housing to capture a ground shield of the cable against the housing, the band comprising a first length portion surrounding the housing and passing through a band buckle and a second length portion extending from the band buckle, the tool comprising:

a rotary clutch tensioning arrangement for developing tension in the first length portion of the band by engaging the band buckle and the second length portion to draw the band through the band buckle, said clutch and tensioning arrangement including a first roller operatively coupled to a handle for rotation in a first rotational direction about a first axis in response to user actuation of said handle and a second roller mounted for rotation about a second axis in spaced parallel relation to said first axis and adjacent the first roller in such position to pinch said band between said first and second rollers and advance the band through the tool in response to rotation of the first roller in said first rotational direction, said first and second rollers each including band engaging circumferential surface areas and also including roller engaging circumferential surfaces whereby said rollers may both pinch the band therebetween at said band engaging surfaces and mutually engage one another for coordinated rotational movement therebetween; and a bending and cutting arrangement for bending the second length portion at a point adjacent the band buckle whereby tension is maintained in the first length portion as said bending and cutting arrangement severs the second length portion to leave an upstanding portion of the band adjacent the buckle such that said upstanding portion is of sufficient length for further bending over the top of the buckle.

* * * * *

UNITED STATES PATENT AND TRADEMARK OFFICE

CERTIFICATE OF CORRECTION

PATENT NO. : 5,193,592

DATED : March 16, 1993

INVENTOR(S) : Evilsizer, et al

It is certified that error appears in the above-identified patent and that said Letters Patent is hereby corrected as shown below:

COLUMN 9, line 30 before "by" insert --operates--.

COLUMN 10, line 31, delete "over".

Signed and Sealed this

Sixteenth Day of November, 1993

*Attest:*

Bruce Lehman

BRUCE LEHMAN

*Attesting Officer*

*Commissioner of Patents and Trademarks*